US005936589A

United States Patent [19]

Kawahata

[11] Patent Number: 5,936,589

[45] **Date of Patent: *Aug. 10, 1999**

[54] DIELECTRIC ROD ANTENNA

[75] Inventor: Kazunari Kawahata, Kyoto, Japan

[73] Assignee: Murata Manufacturing Co., Ltd., Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/943,854

[22] Filed: Oct. 17, 1997

Related U.S. Application Data

[63] Continuation of application No. 08/564,723, Nov. 29, 1995, abandoned.

[30] Foreign Application Priority Data

Nov. 29, 1994 [JP] Japan ..... 6-294751
Aug. 25, 1995 [JP] Japan ..... 7-217580

[51] Int. Cl.[6] ..... H01Q 13/00

[52] U.S. Cl. ..... 343/785; 343/901; 343/903

[58] Field of Search ..... 343/785, 750, 343/900, 901, 903

[56] References Cited

U.S. PATENT DOCUMENTS

H000584 2/1989 Schwering et al. ..... 343/785
3,128,467 4/1964 Lanctot ..... 343/785

FOREIGN PATENT DOCUMENTS 0612120 2/1994 European Pat. Off. .
3204977 2/1982 Germany .
3604355 2/1986 Germany .
518194 4/1955 Italy ..... 343/785
282449 4/1974 Russian Federation ..... 343/785

OTHER PUBLICATIONS

"Dielectric Antenna", Yohei Ishikawa, Patents Abstracts of Japan, E–945, Jun. 27, 1990, vol. 14, No. 297.

"Dielektrische Richstrahler", Teil I. Stielstrahler, Fernmeldetechnische Zeitschrift, Jahrg. 2, Heft 2, Feb. 1949.

*Primary Examiner*—Don Wong
*Assistant Examiner*—Tho Phan
*Attorney, Agent, or Firm*—Ostrolenk, Faber, Gerb & Soffen, LLP

[57] ABSTRACT

A dielectric rod antenna has a dielectric rod and a waveguide which receives one end of the dielectric rod to excite the dielectric rod. The dielectric rod is divided along its length into at least two sections including a hollow tubular dielectric sleeve and a dielectric internal rod telescopically received and secured in the hollow of the dielectric sleeve. One end of the dielectric internal rod makes a releasable-fit engagement with the adjacent end of the dielectric sleeve so that the overall length of the antenna can be fixed against change during the use. The overall radius and the hollow radius of the dielectric sleeve and the overall radius of the dielectric internal rod are determined such that the propagation constant in the dielectric sleeve and the propagation constant in the dielectric internal rod are equalized to each other. The end of the dielectric internal rod adjacent to the dielectric sleeve is tapered so as to converge towards the end extremity.

6 Claims, 10 Drawing Sheets

DIELECTRIC ROD ANTENNA

This is a continuation of application Ser. No. 08/564,723 filed on Nov. 29, 1995 now abandoned.

BACKGROUND OF THE INVENTION

1. Field of the Invention

The present invention relates to a dielectric rod antenna and, more particularly, to a portable dielectric rod antenna which is capable of receiving broadcast signals from a satellite.

2. Description of the Related Art

A conventional dielectric rod antenna has a dielectric rod made of a dielectric material and a waveguide which receives the dielectric rod so as to excite the rod. This type of antenna is used, for example, as a primary radiator of a parabolic antenna.

FIG. 8 schematically shows the general appearance of a known dielectric rod antenna. This dielectric rod antenna 10 has a dielectric rod 1, an exciting waveguide 2 receiving one end of the dielectric rod 1, a converter 3 attached to the waveguide 2 and a connector 4 provided on the converter 3. The dielectric rod 1 is made of a material which excels in its mechanical properties and which exhibits low dielectric losses, such as polypropylene, polystyrene, TPX, Teflon or the like.

In order for the dielectric antenna 10 to have a large enough gain to enable reception of broadcast signals from a satellite, the length of the dielectric rod 1 and the diameter of the cross-section perpendicular to the longitudinal axis of the dielectric rod 1 are given predetermined suitable values. For instance, when the length and the cross-sectional diameter of the dielectric rod 1 are 50 cm and 9 mm, respectively, the dielectric rod antenna 10 exhibits a gain of 23 dBi at a frequency of 12 GHz, thus clearing the minimum level (about 18 dBi or higher) of the antenna gain required for transmission in the microwave band between 10 GHz and 15 GHz.

Determination of the length and diameter of the dielectric rod 1 on the basis of the antenna gain alone, however, involves risks, such as the risk of reduction of the gain due to deflection or warp of the rod during the forming of the rod, reduction in its mechanical strength, and so forth. In addition, the portability of the dielectric rod antenna 10 may be impaired when the dielectric rod 1 is too long.

SUMMARY OF THE INVENTION

Accordingly, an object of the present invention is to provide a dielectric rod antenna which has sufficiently high levels of mechanical strength and gain, by virtue of elimination of deflection or warp during formation of the dielectric rod, and which excels in portability.

To this end, according to an embodiment of the present invention, there is provided a dielectric rod antenna comprising a dielectric rod, and a waveguide which receives one end of the dielectric rod to excite the dielectric rod, wherein the dielectric rod is divided along its length into at least two sections including at least one hollow tubular dielectric sleeve and a dielectric internal rod, the hollow of the dielectric sleeve receiving either a further dielectric sleeve or the dielectric internal rod which is telescopically secured therein.

The arrangement may be such that one end of the further dielectric sleeve or of the dielectric internal rod makes a releasable-fit engagement with one end of the dielectric sleeve so that the further dielectric sleeve or the dielectric internal rod is supported in the dielectric sleeve.

Preferably, the overall radius and the hollow radius of the dielectric sleeve and the overall radius of the dielectric internal rod are determined such that the propagation constant in the dielectric sleeve and the propagation constant in the dielectric internal rod are equalized to each other.

The end of the dielectric internal rod adjacent to the dielectric sleeve may be tapered so as to converge towards the end extremity.

According to the above aspects of the present invention, the dielectric rod is composed of a plurality of sections which can be formed separately and each of which is small in length as compared with conventional elongated integral dielectric rod. It is therefore possible to suppress deflection or warp of the dielectric rod during the forming of the rod.

The whole dielectric rod is telescopically extendable and contractible by virtue of the fact that the hollow of the dielectric sleeve receives a further dielectric sleeve or the dielectric internal rod.

When the arrangement is such that the dielectric internal rod is supported in the hollow of the dielectric sleeve by a releasable-fit engagement between adjacent ends of these two members, it is possible to fix the overall length of the dielectric rod against any change during the use of the dielectric rod antenna, while preventing the dielectric internal rod from coming off the dielectric sleeve.

It is also possible to reduce the reflection loss which occurs at the juncture between the dielectric sleeve and the dielectric internal rod when the wave is guided from the dielectric sleeve into the dielectric internal rod, by suitably determining the overall radius and the hollow radius of the dielectric sleeve and the overall radius of the dielectric internal rod, such that the propagation constant in the dielectric sleeve and the propagation constant in the dielectric internal rod are equalized.

When the end of the dielectric internal rod adjacent to the dielectric sleeve is tapered to converge towards the end extremity, it is possible to obtain a matching of propagation characteristic between the dielectric sleeve and the dielectric internal rod, thus achieving a high waveguide efficiency.

Other features and advantages of the present invention will become apparent from the following description of the invention which refers to the accompanying drawings.

DETAILED DESCRIPTION OF AN EMBODIMENT OF THE INVENTION

Figure 1:
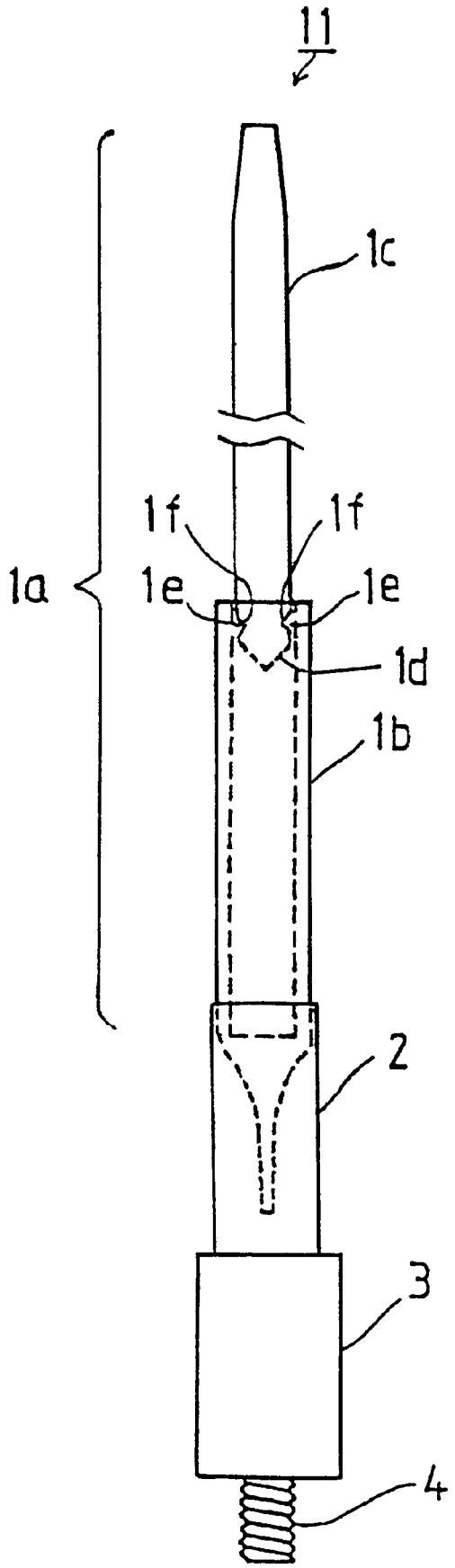
FIG. 1 is a partly transparent elevational view of an embodiment of the dielectric antenna of the present invention in the state of use.
Figure 7:
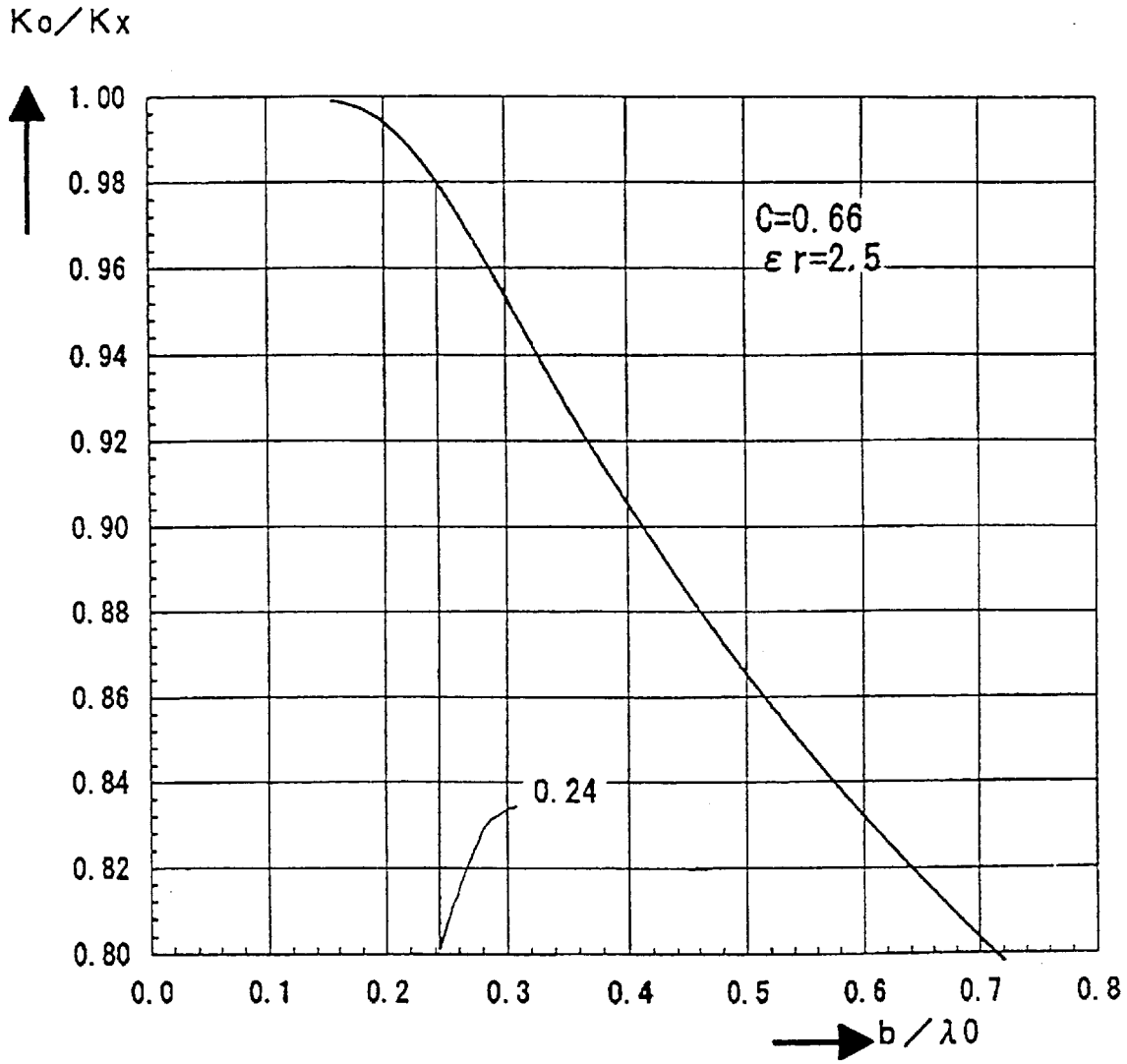
FIG. 7 is a graph showing the results of calculation of the phase velocity of a dielectric sleeve as obtained when the dielectric constant $\in_r$ and the ratio c (hollow radius/overall radius) are 2.5 and 0.66, respectively.
Figure 8:
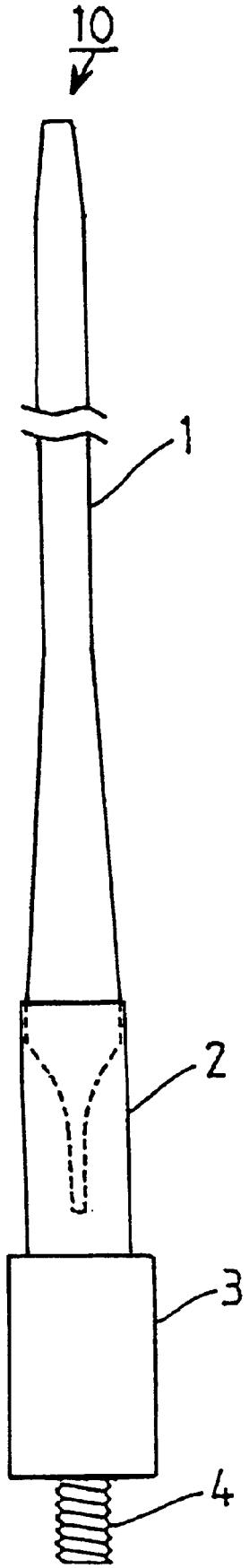
FIG. 8 PRIOR ART
FIG. 8 shows the general appearance of a known dielectric rod antenna.

An embodiment of the dielectric rod antenna in accordance with the present invention will be described with reference to FIGS. 1 to 7. FIG. 1 is a partly transparent elevational view of an embodiment of the dielectric rod antenna 11 in the state of use. In this Figure, components same as or corresponding to those shown in FIG. 8 are denoted by the same reference numerals, and detailed description is omitted in regard to such components.

Referring to FIG. 1, a dielectric rod 1*a* includes a hollow tubular dielectric sleeve 1*b* and a dielectric internal rod 1*c* which is disposed in the hollow of the dielectric sleeve 1*b*. The end 1*d* of the dielectric internal rod 1*c* adjacent to the dielectric sleeve 1*b* is tapered so as to converge towards the base end of the antenna.

Figure 9:
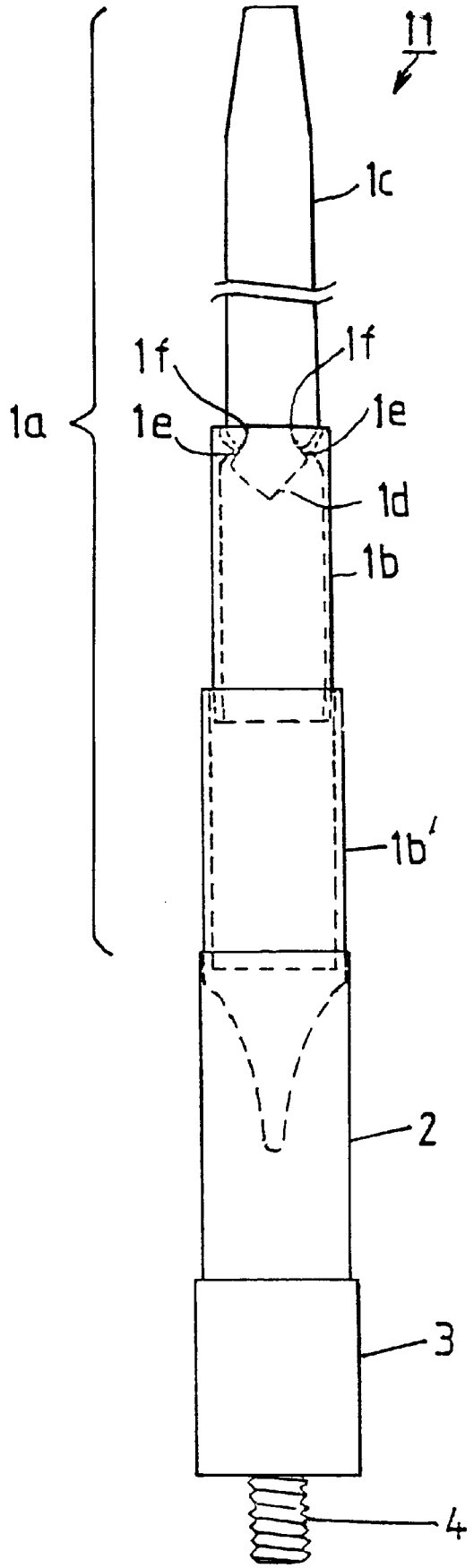
FIG. 9 is a partly transparent elevational view of another embodiment of the dielectric antenna of the present invention in the state of use.
Figure 10:
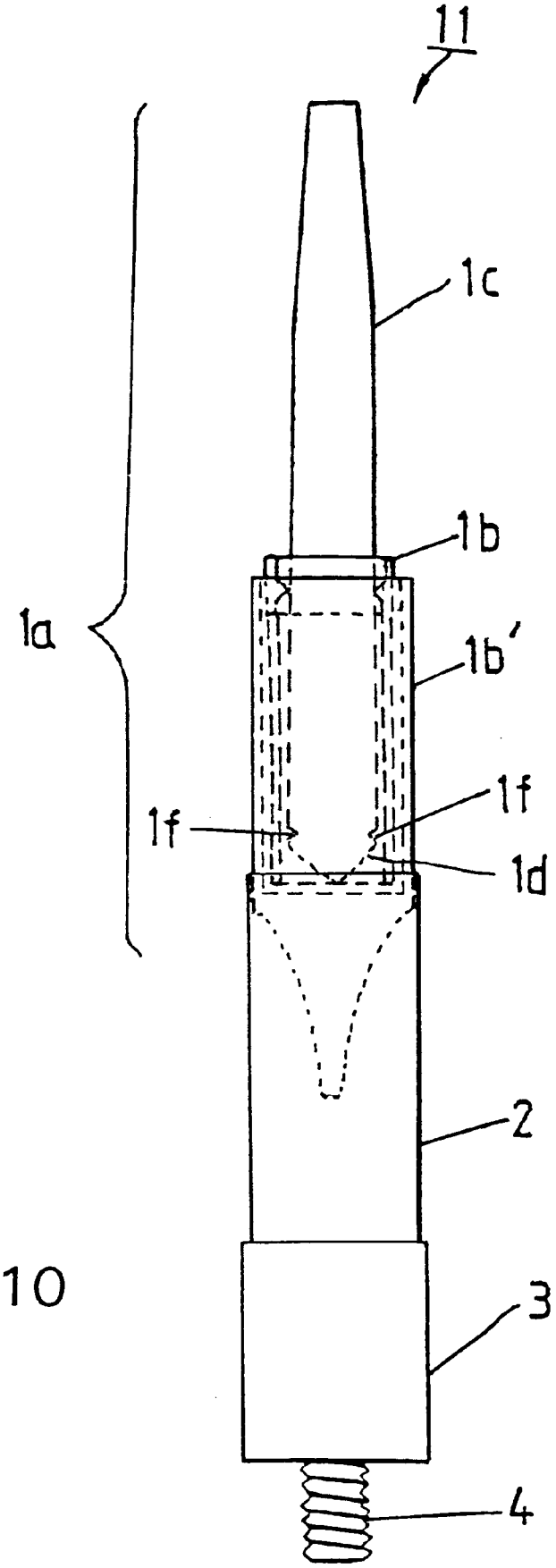
FIG. 10 is a partly transparent elevational view of the embodiment shown in FIG. 9 in the state of non-use.

The dielectric rod antenna of the present invention may employ a plurality of dielectric sleeves as shown in FIGS. 9 and 10, which are telescopically assembled such that one dielectric sleeve is received in another dielectric sleeve, with the dielectric internal rod 1*c* received in the hollow of the innermost dielectric sleeve.

For the sake of simplicity, the explanation is provided herein below with reference to the dielectric rod antenna shown in FIGS. 1 and 2.

Referring further to FIG. 1, an annular ridge 1*e* is formed on the inner surface of the dielectric sleeve 1*b* at a position close to one end of the sleeve 1*b*, while a mating annular recess 1*f* is formed close to the associated end of the dielectric rod 1*c*. The annular ridge 1*e* makes a releasable fit, e.g., a snap fit, in the annular recess 1*f* so that the dielectric internal rod 1*c* is supported in the dielectric sleeve 1*b*.

Preferably, a length, along a direction of expansion of the antenna, of a part in which the internal rod and the dielectric sleeve are directly connected, may be substantially ¼ of an object wavelength of the antenna.

Figure 2:
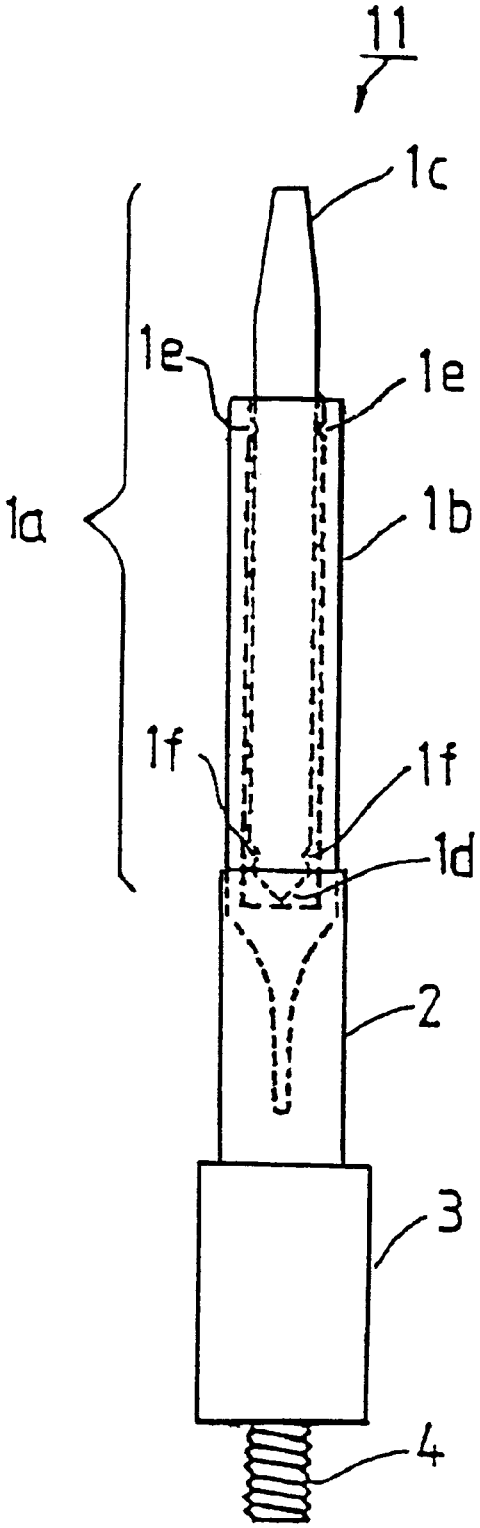
FIG. 2 is a partly transparent elevational view of the embodiment shown in FIG. 1 in the state of non-use.

FIG. 2 is a partly transparent elevational view of the dielectric rod antenna 11 shown in FIG. 1 in its inoperative state. Components which are the same as those appearing in FIG. 1 are denoted by the same reference numerals as those used in FIG. 1, and detailed description is omitted in regard to such components. It will be seen that most of the length of the dielectric internal rod 1*c* is received in the hollow of the dielectric sleeve 1*b*.

Thus, in the dielectric rod antenna 11 shown in FIGS. 1 and 2, the dielectric rod 1*a* is composed of a plurality of sections: e.g., the dielectric sleeve 1*b* and the dielectric internal rod 1*c*, each section having a length smaller than that of the conventional integral dielectric rod. According to the invention, therefore, the tendency for the dielectric rod 1*a* to warp during its formation is suppressed, thus avoiding the risk of an undesirable reduction in the gain of the dielectric rod antenna 11, as well as a reduction in its mechanical strength.

The dielectric internal rod 1*c* is telescopically secured in the hollow of the dielectric sleeve 1*b*, so that the whole dielectric rod 1*a* is expandable and contractible by virtue of the above-mentioned releasable fit. Therefore, when the dielectric antenna 11 is not used, the internal rod 1*c* can be inserted deeper into the dielectric sleeve 1*b*, overcoming the frictional resistance of the releasable fit, so that the overall length of the dielectric rod 1*a* is reduced, thus achieving improved portability of the whole dielectric rod antenna 11.

The dielectric internal rod 1*c* is supported in a predetermined position in the dielectric sleeve 1*b*, by virtue of the mutual engagement between the ridge 1*e* formed on the inner surface of the dielectric sleeve 1*b* near one end of the sleeve 1*b* and the annular recess 1*f* formed at the adjacent end of the dielectric internal rod 1*c*. This arrangement ensures that the overall length of the dielectric rod 1*a* is not changed during the use of the dielectric rod antenna 11, while preventing the dielectric internal rod 1*c* from coming off the dielectric sleeve 1*b*.

The converging tapered end 1*d* of the dielectric internal rod 1*c* adjacent the dielectric sleeve 1*b* offers an advantage in that it improves matching in regard to wave propagation characteristics when the wave is guided from the dielectric sleeve 1*b* into the dielectric rod 1*c*. It is therefore possible to efficiently guide waves from the dielectric sleeve 1*b* into the dielectric internal rod 1*c*.

When waves are guided from the dielectric sleeve 1*b* into the dielectric internal rod 1*c*, a reflection loss takes place in the region where the dielectric internal rod 1*c* is secured to the dielectric sleeve 1*b*. In order to reduce such a reflection loss, it is desirable to determine the configurations of the dielectric sleeve 1*b* and the dielectric internal rod 1*c* such that the dielectric sleeve 1*b* has a propagation constant which is equal to that of the dielectric internal rod 1*c*.

Figure 3A:
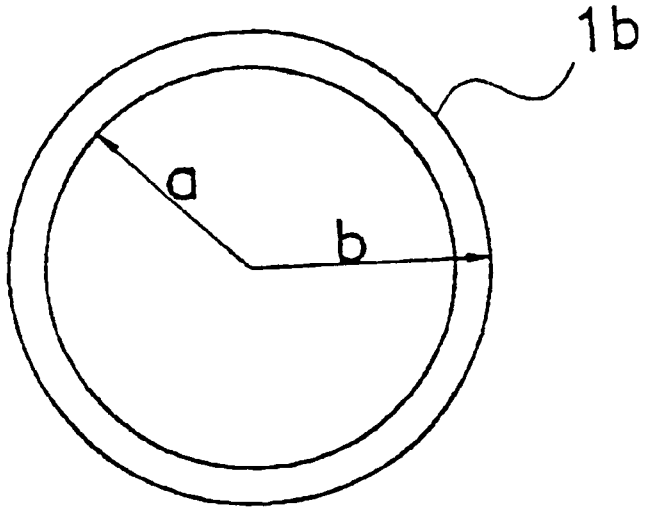
FIG. 3A is a sectional view of a dielectric sleeve incorporated in the embodiment shown in FIG. 1, taken along a plane which is perpendicular to the longitudinal axis of the dielectric sleeve.
Figure 3B:
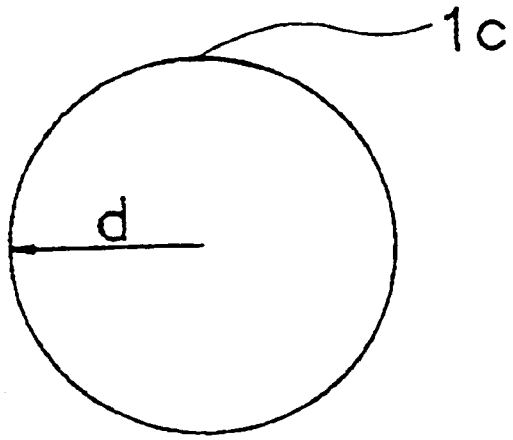
FIG. 3B is a sectional view of a dielectric internal rod incorporated in the embodiment shown in FIG. 1, taken along a plane which is perpendicular to the longitudinal axis of the dielectric internal rod.

The inventors therefore made a study in which the propagation constant of the dielectric sleeve 1*b* was calculated for various values of the radius "a" of the hollow of the dielectric sleeve 1*b* and the overall radius "b" of the dielectric sleeve 1*b*, and the propagation constant of the dielectric internal rod 1*c* also was calculated for various values of the overall radius "d" of the dielectric internal rod 1*c*. The definitions of the radius "a" of the hollow of the dielectric sleeve 1*b* and the overall radius "b" of the dielectric sleeve 1*b* are shown in FIG. 3A which is a sectional view of the dielectric sleeve 1*b* taken at a plane perpendicular to the longitudinal axis of the dielectric sleeve 1*b*, while the overall radius "d" of the dielectric internal rod 1*c* is shown in FIG. 3B which is a sectional view of the dielectric internal rod 1*c* taken at a plane perpendicular to the longitudinal axis of the rod 1*c*.

Figure 4:
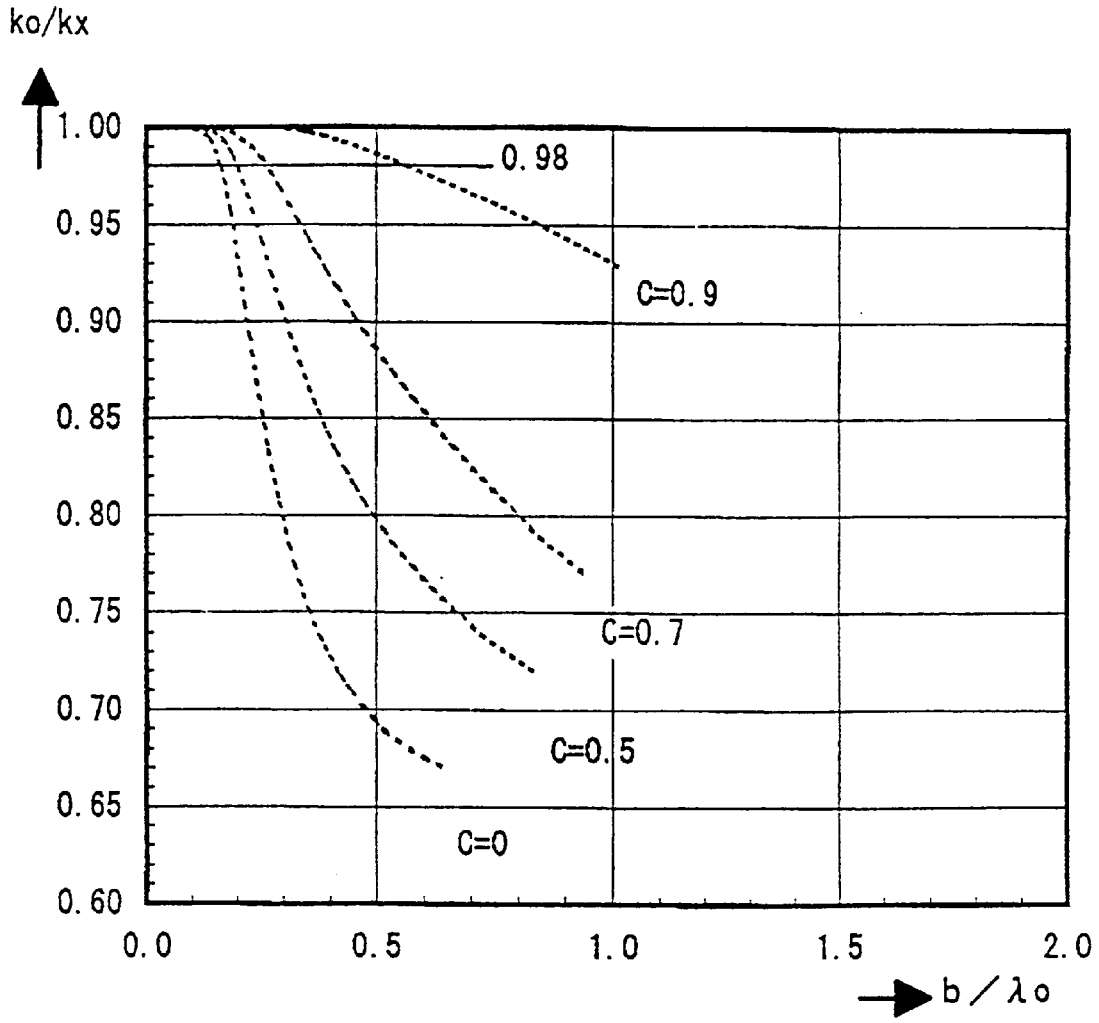
FIG. 4 is a graph showing the results of calculation of phase velocity of a dielectric sleeve having a dielectric constant $\in r$ of 2.5.

FIG. 4 shows the results of calculation of the propagation constant in the dielectric sleeve 1*b* as obtained when the specific dielectric constant $\in_r$ of the dielectric sleeve 1*b* is 2.5. In the graph shown in FIG. 4, the abscissa represents the normalized overall radius "b" of the dielectric sleeve 1*b* expressed by $b/\lambda_0$, while the ordinate represents the normalized phase velocity of the dielectric sleeve 1*b* expressed by $k_0/k_x$, where $\lambda_0$ and $k_0$ respectively represent the wavelength of the wave in free space and the propagation constant in free space. There is a relationship represented by $k_0=2\pi/\lambda 0$, between the wavelength $\lambda 0$ and the propagation constant $k_0$. Symbol $k_x$ represents the longitudinal propagation constant of the dielectric sleeve 1*b*. Representing the wavelength of a wave propagating through the dielectric sleeve 1*b* by $\lambda_x$, the propagation constant $k_x$ is given by $k_x=2\pi/\lambda_x$. The ratio (a/b) between the hollow radius "a" and the overall radius "b" of the dielectric sleeve 1*b* is represented by "c".

The phase velocity in the dielectric sleeve 1*b* was calculated for four cases, namely c=0, c=0.5, c=0.7 and c=0.9. As a result, a relationship between $b/\lambda_0$ and $k_0/k_x$ as shown in FIG. 4 was obtained.

Figure 5:
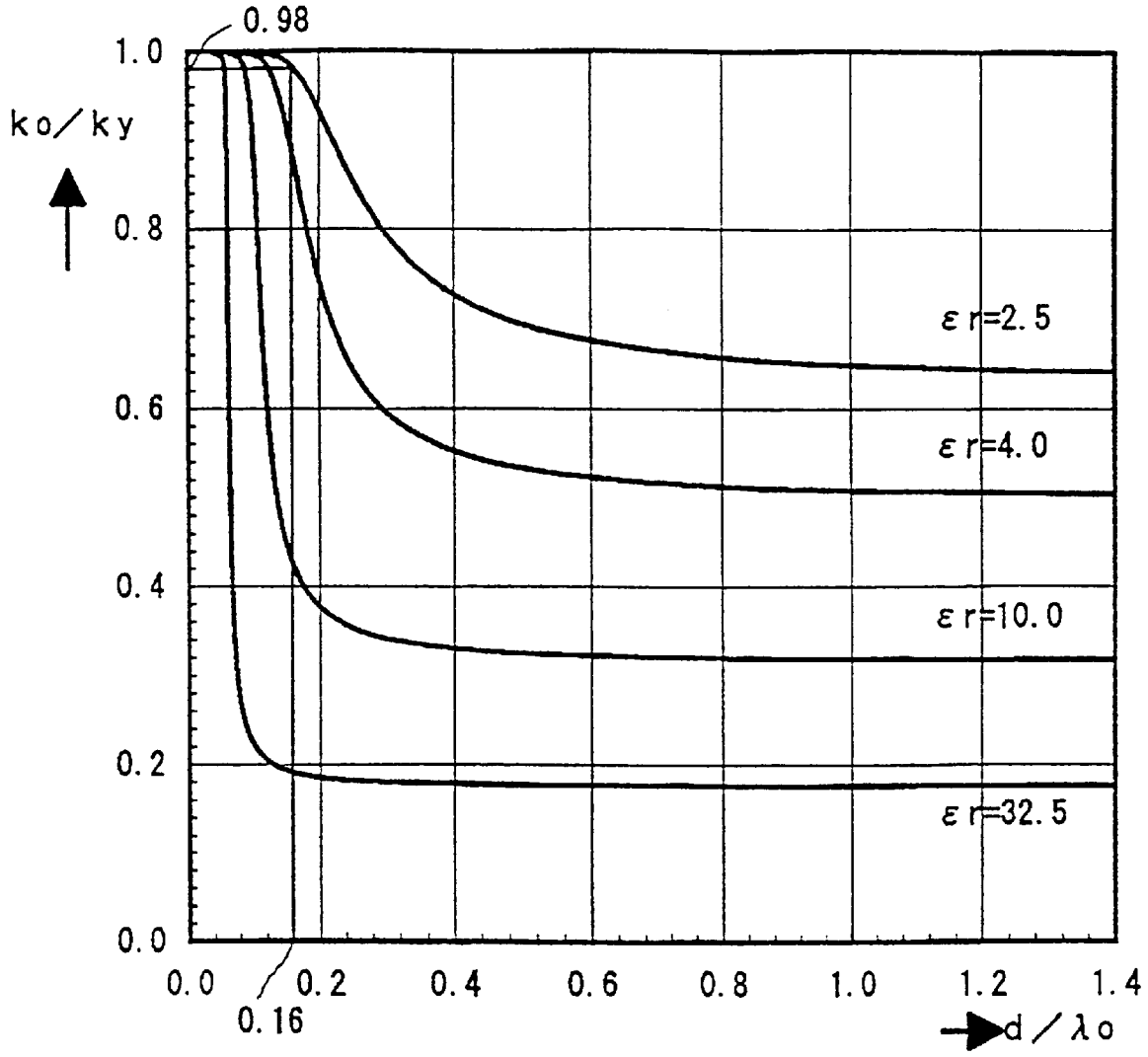
FIG. 5 is a graph showing the results of calculation of phase velocity of the dielectric internal rod.

FIG. 5 shows the results of calculation of the propagation constant in the dielectric internal rod 1*c*. In the graph shown in FIG. 5, the abscissa represents the normalized overall radius "d" of the dielectric internal rod 1*c* expressed by $d/\lambda_x$, while the ordinate represents the normalized phase velocity in the dielectric internal rod 1*c* expressed by $k_0/k_y$, where $\lambda_0$ and $k_0$ respectively represent the wavelength of the wave in free space and the propagation constant in free space which are the same as those explained in connection with FIG. 4. Symbol $k_y$ represents the longitudinal propagation constant in the dielectric internal rod 1*c*. Representing the wavelength of a wave propagating through the dielectric internal rod 1*c* by $\lambda_y$, the propagation $k_y$ is given by $k_y=2\pi/\lambda_y$.

The phase velocity in the dielectric internal rod 1*c* was calculated for four cases, namely $\in_r=2.5$, $\in_r=4.0$, $\in_r=10.0$ and $\in_r=32.5$. As a result, a relationship between $d/\lambda_0$ and $k_0/k_y$ as shown in FIG. 5 was obtained.

In order for the propagation constant in the dielectric sleeve 1*b* and the propagation constant in the dielectric internal rod 1*c* to be equalized, it is necessary for the normalized phase velocity $k_0/k_x$ in the dielectric sleeve 1*b* and the normalized phase velocity $k_0/k_y$ in the dielectric internal rod 1*c* to be equal to each other.

Furthermore, in order for the dielectric internal rod 1*c* to be secured in the hollow of the dielectric sleeve 1*b* without a gap, it is necessary for the radius "a" of the hollow in the dielectric sleeve 1*b* and the overall radius "d" of the dielectric internal rod 1*c* to be substantially equal to each other.

A discussion will now be given of the hollow radius "a" and the overall radius "b" of the dielectric sleeve 1*b* and the overall radius "d" of the dielectric internal rod 1*c* which satisfy the above-described requirements, on the assumption that the condition of $k_0/k_x=k_0/k_y=0.98$ is met while both the dielectric sleeve 1*b* and the dielectric internal rod 1*c* have an equal specific dielectric constant $\in_r$ of 2.5 ($\in_r=2.5$).

Figure 6:
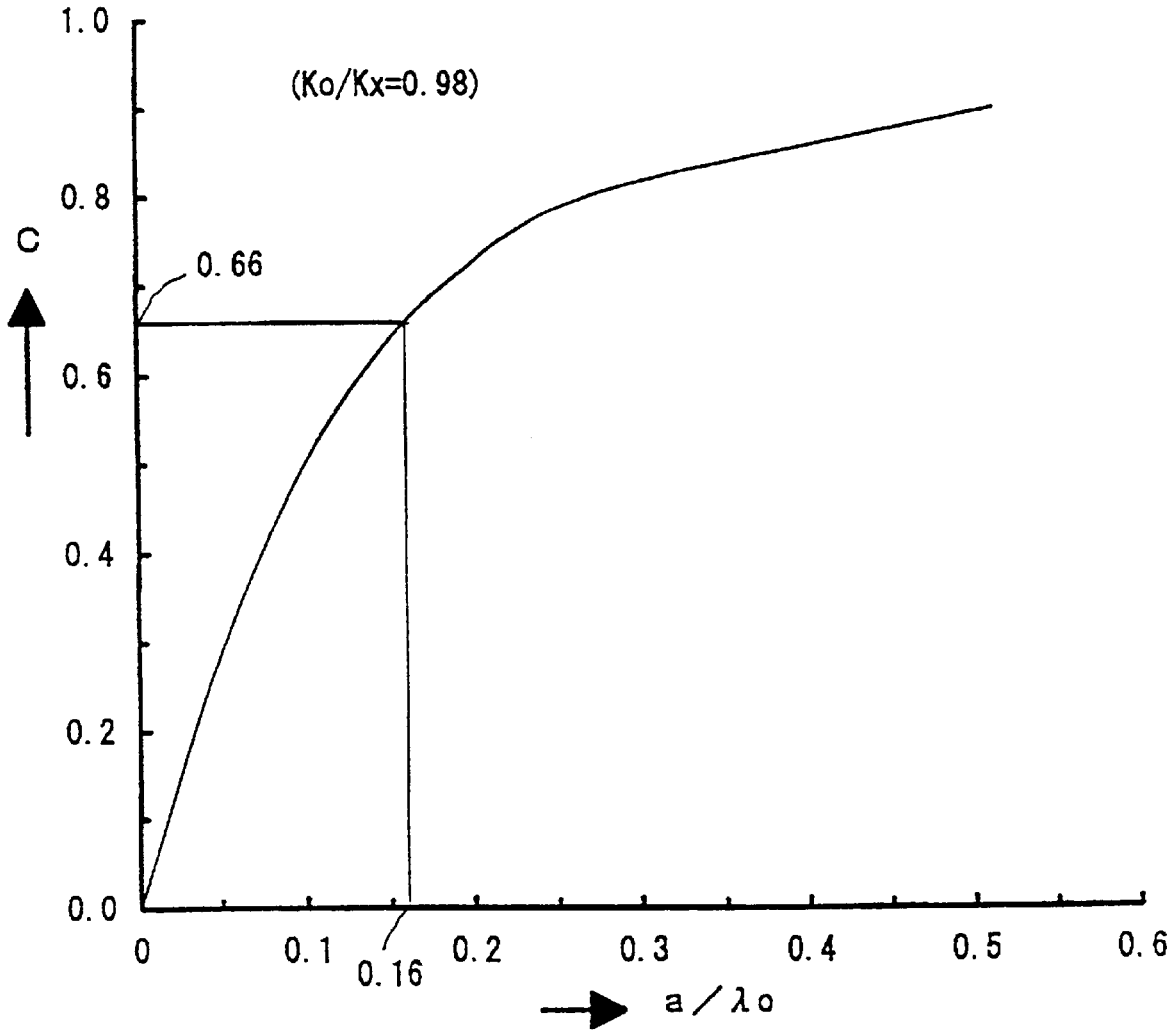
FIG. 6 is a graph showing the relationship between the normalized radius of the hollow of a dielectric sleeve and the ratio (hollow radius/overall radius) of the dielectric sleeve, as observed when the normalized phase velocity of the dielectric sleeve is 0.98.

FIG. 6 shows the relationship which is derived from FIG. 4 and which represents the relationship between the normalized radius "a" of the hollow of the dielectric sleeve 1*b* expressed by $a/\lambda_0$ and the ratio c expressed by a/b. It is also understood from FIG. 5 that the value $d/\lambda_0$ is about 0.16, when the specific dielectric constant $\in_r$ is 2.5 while the ratio $k_0/k_y$ is 0.98.

The value of the ratio "c", which satisfies the condition of $a/\lambda_0=d/\lambda_0$=about 1.6, is located as being about 0.66 (c=0.66) on FIG. 6. A calculation of the phase velocity in the dielectric sleeve 1*b*, when c=0.66 and $\in r=2.5$, proves that a relationship exists as shown in FIG. 7 between $b/\lambda_0$ and $k_0/k_x$. From FIG. 7, it is derived that the value $b/\lambda_0$ is about 0.24 ($b/\lambda_0=0.24$) under the condition $k_0/k_x=0.98$.

The propagation constants in the dielectric sleeve 1*b* and the dielectric internal rod 1*c* can thus be equalized by suitable determination of the radius "a" of the hollow of the dielectric sleeve 1*b*, the overall radius "b" of the dielectric sleeve 1*b* and the overall radius "d" of the dielectric internal rod 1*c*. Accordingly, it is possible to reduce the reflection loss which occurs at the region where the dielectric internal rod 1*c* is secured to the dielectric sleeve 1*b* when the waves are guided into the dielectric internal rod 1*c* from the dielectric sleeve 1*b*.

The value of $k_0/k_x$, i.e., the normalized phase velocity in the dielectric sleeve 1*b*, and the value of $k_0/k_y$, i.e., the normalized phase velocity in the dielectric internal rod 1*c*, are preferably close to 1.0, in order to attain a high efficiency of radiation of electric waves into free space.

As will be understood from the foregoing description, the present invention offers various advantages.

According to the main feature of the present invention, the dielectric rod is composed of a plurality of sections including a dielectric sleeve and a dielectric internal rod. These sections can be formed separately in lengths which are small as compared with a conventional elongated integral dielectric rod. It is therefore possible to suppress deflection or warp of the dielectric rod during their formation, thus eliminating the risk of reduction in the gain and mechanical strength of the dielectric rod antenna.

The whole dielectric rod is telescopically extendable and contractible by virtue of the fact that the dielectric sleeve receives another dielectric sleeve or the dielectric internal rod. The overall length of the dielectric rod can therefore be reduced when the antenna is not used, thus improving portability of the dielectric rod antenna.

Since the arrangement is such that the dielectric internal rod is supported in the hollow of the dielectric sleeve by a releasable-fit engagement between adjacent ends of these two members, it is possible to fix the overall length of the dielectric rod against any change during the use of the dielectric rod antenna, while preventing the dielectric internal rod from coming off the dielectric sleeve.

It is also possible to reduce the reflection loss which occurs at the juncture between the dielectric sleeve and the dielectric internal rod when the wave is guided from the dielectric sleeve into the dielectric rod, by suitably determining the overall radius and the hollow radius of the dielectric sleeve and the overall radius of the dielectric internal rod, such that the propagation constant of the dielectric sleeve and the propagation constant of the dielectric internal rod are equalized.

When the end of the dielectric internal rod adjacent to the dielectric sleeve is tapered to converge towards the end extremity, it is possible to obtain a matching of propagation characteristic between the dielectric sleeve and the dielectric internal rod, thus achieving a high waveguide efficiency.

Although the present invention has been described in relation to a particular embodiment thereof, many other variations and modifications and other uses will become apparent to those skilled in the art. It is preferred, therefore, that the present invention be limited not by the specific disclosure herein, but only by the appended claims.

What is claimed is:

1. A dielectric rod antenna comprising:

a dielectric rod; and a waveguide which receives one end of said dielectric rod to excite said dielectric rod;

wherein said dielectric rod is divided along its length into at least two sections including at least one hollow tubular dielectric sleeve having an external radius and an internal radius and a dielectric internal rod having a radius, the hollow of said at least one dielectric sleeve receiving said dielectric internal rod telescopically secured therein; and wherein, for a desired phase velocity of a wave propagating inside said dielectric sleeve and a wave propagating inside said dielectric internal rod, the internal radius of said dielectric sleeve and the radius of said dielectric internal rod are the same, and the external radius of said dielectric sleeve has a value derived from the ratio of the internal radius and external radius of the dielectric sleeve, said ratio being determined on the basis of the desired phase velocity and the internal radius of the dielectric sleeve.

2. A dielectric rod antenna according to claim 1, wherein one end of said dielectric internal rod makes a releasable-fit engagement with one end of said dielectric sleeve so that said dielectric internal rod is supported in a predetermined position in said dielectric sleeve.

3. A dielectric rod antenna according to either claim 1 or claim 2, wherein an end of said dielectric internal rod adjacent to said dielectric sleeve is tapered so as to converge towards the dielectric sleeve.

4. A dielectric rod antenna according to claim 3, wherein a length, along a direction of expansion of the antenna, of a part in which said internal rod and said dielectric sleeve are directly contacted, is substantially ¼ of an object wavelength of the antenna.

5. A dielectric rod antenna according to claim 1, wherein an end of said dielectric internal rod adjacent to said dielectric sleeve is tapered so as to converge towards the dielectric sleeve.

6. A dielectric rod antenna accordingly to claim 5, wherein a length, along a direction of expansion of the antenna, of a part in which said internal rod and said dielectric sleeve are directly contacted, is substantially ¼ of an object wavelength of the antenna.

* * * * *